US008487829B2

(12) United States Patent
Takisawa et al.

(10) Patent No.: US 8,487,829 B2
(45) Date of Patent: Jul. 16, 2013

(54) ANTENNA UNIT INCLUDING A SHIELD COVER HAVING A CEILING PORTION WITH A MOUNTER VACUUMED PORTION

(75) Inventors: Hisashi Takisawa, Tokyo (JP); Takao Kato, Tokyo (JP); Junichi Noro, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 441 days.

(21) Appl. No.: 12/824,476

(22) Filed: Jun. 28, 2010

(65) Prior Publication Data

US 2010/0328179 A1 Dec. 30, 2010

(30) Foreign Application Priority Data

Jun. 29, 2009 (JP) ..... 2009-154124

(51) Int. Cl.
*H01Q 1/52* (2006.01)

(52) U.S. Cl.
USPC ..... 343/841

(58) Field of Classification Search
USPC ..... 343/841, 702, 713, 872, 700 MS
See application file for complete search history.

(56) References Cited

U.S. PATENT DOCUMENTS

| | | | | |
|---|---|---|---|---|
| 7,327,328 | B2 | 2/2008 | Yoneya et al. | |
| 7,339,538 | B2 | 3/2008 | Yoneya et al. | |
| 7,577,398 | B2 * | 8/2009 | Judd et al. | 455/11.1 |
| 2004/0110469 | A1 * | 6/2004 | Judd et al. | 455/15 |
| 2008/0055184 | A1 * | 3/2008 | Noro et al. | 343/872 |
| 2008/0292846 | A1 | 11/2008 | Muranaga | |
| 2010/0182206 | A1 * | 7/2010 | Barbieri et al. | 343/702 |
| 2011/0312269 | A1 * | 12/2011 | Judd et al. | 455/11.1 |

FOREIGN PATENT DOCUMENTS

| | | | |
|---|---|---|---|
| JP | 2005-276934 | A | 10/2005 |
| JP | 2006-237917 | A | 9/2006 |
| JP | 2006-237951 | A | 9/2006 |
| JP | 2006-344716 | A | 12/2006 |
| JP | 2006-344814 | A | 12/2006 |
| JP | 2008-061084 | A | 3/2008 |

OTHER PUBLICATIONS

Japanese Office Action dated Apr. 20, 2011 (and English translation of relevant part thereof) in counterpart Japanese Application No. 2009-154124.

* cited by examiner

*Primary Examiner* — Huedung Mancuso
(74) *Attorney, Agent, or Firm* — Holtz, Holtz, Goodman & Chick, PC

(57) ABSTRACT

A shield cover is disposed so as to be opposed to a bottom plate and electromagnetic-shields a signal processing circuit mounted on a rear surface of a circuit board. The shied cover has a ceiling portion which includes a mounter vacuumed portion disposed in a center portion of the ceiling portion and vacuumed by a vacuum nozzle of a mounter, a ring-shaped outer edge disposed from an end of the side wall portion inwardly, and a plurality of beam portions joining the mounter vacuumed portion to the outer edge. An electromagnetic shielding of the signal processing unit is carried out using both of the shield cover and the bottom plate.

12 Claims, 10 Drawing Sheets

ANTENNA UNIT INCLUDING A SHIELD COVER HAVING A CEILING PORTION WITH A MOUNTER VACUUMED PORTION

This application is based upon and claims the benefit to priority from Japanese patent application No. 2009-154124, filed on Jun. 29, 2009, the disclosure of which is incorporated herein in its entirety by reference.

BACKGROUND OF THE INVENTION

This invention relates to an antenna unit for receiving satellite signals transmitted from artificial satellite and, in particular, relates to a shield cover used in the antenna unit and a method of fabricating an antenna module.

Various antenna units for receiving satellite signals transmitted from artificial satellites have been proposed. For example, such antenna units include a Global Positioning System (GPS) antenna unit for receiving GPS signals transmitted from GPS satellites and a Satellite Digital Audio Radio Service (SDARS) antenna unit for receiving SDARS signals transmitted from SDARS satellites.

For instance, in recent years, the so-called global positioning system has been spreading in which a receiver receives signal waves transmitted respectively from a plurality of artificial satellites orbiting the earth and the current position of the receiver itself is detected based on information included in the received signal waves. This system is generally called a GPS (Global Positioning System) in those countries such as Japan and USA. The GPS generally uses GPS satellites controlled by the US Department of Defense. As similar systems, there are "GALILEO" used in Europe and "GLONASS" used in Russia. Herein, a positioning system using artificial satellites, the artificial satellites used in the positioning system, signal waves transmitted from the artificial satellites, receivers for receiving the signal waves, and so on are referred to as a GPS, GPS satellites, GPS signals, GPS receivers, and so on, respectively, for convenience sake.

The GPS is capable of detecting a current position of a GPS receiver itself with high accuracy and substantially in real time. Accordingly, the GPS is mainly used such that a GPS receiver is mounted in a moving object such as an automobile, an airplane, or a portable telephone and the current position of the moving object is measured.

Presently, GPS receivers that are suitable when installed in automobiles, i.e. so-called car GPS receivers, are rapidly spreading. When installing the GPS receiver in the automobile, a GPS receiving antenna unit for receiving GPS signals may be almost disposed outside the automobile, for example, on a roof.

On the other hand, the SDARS (Satellite Digital Audio Radio Service) is a radio service according to a digital radio broadcasting using artificial satellites (which will called "SDARS satellites" hereinafter) in the United States of America. That is, in recent years, a digital radio receiver, which receives the satellite wave from the SDARS satellites or the terrestrial wave so as to listen to the digital radio broadcasting, has been developed and is put to practical use in the United States of America. Specifically, two broadcasting stations called XM and Sirius provide radio programs on 250 or more channels in total. The digital radio receiver is generally mounted on a mobile object such as an automobile and is adapted to receive a radio wave having a frequency of about 2.3 gigahertz (GHz) as a received wave to listen to the digital radio broadcasting. In other words, the digital radio receiver is a radio receiver capable of listening to mobile broadcasting. Inasmuch as the received wave has the frequency of about 2.3 GHz, a reception wavelength (resonance frequency) $\lambda$ thereof is equal to about 128.3 mm. It is noted here that the terrestrial wave is a radio wave obtained by receiving the satellite wave at a ground station, slightly shifting the frequency of the satellite wave, and retransmitting the linear polarized wave. Thus, the terrestrial wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized waves, receives a radio wave by using a terrestrial linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a terrestrial linear polarization portion of the radio antenna apparatus.

As described above, the radio wave having the frequency of about 2.3 GHz is used in the digital radio broadcasting. Therefore, an antenna for receiving the radio wave may be almost located outside as known in the art. If the digital radio receiver is mounted in the mobile object such as the automobile, the antenna unit may be almost attached to a roof of the mobile object (car body).

Such various antenna units for receiving satellite signals transmitted from artificial satellites have been proposed. For example, an antenna unit capable of easily positioning a packing member to a top cover is disclosed in Japanese Unexamined Patent Publication Tokkai No. 2006-237917, namely, JP 2006-237917 A which is called Patent Document 1 hereinafter. An easy-to-assemble antenna unit is disclosed in U.S. Pat. No. 7,339,538 issued to Akira Yoneya et al. that will be called Patent Document 2 hereinafter. Furthermore, an antenna unit capable of improving a waterproofing function is disclosed in Japanese Unexamined Patent Publication Tokkai No. 2006-237951, namely, JP 2006-237951 A which is called Patent Document 3 hereinafter.

In addition, a shield cover used in an antenna unit is disclosed in U.S. Pat. No. 7,327,328 issued to Akira Yoneya et al. that will be called Patent Document 4 hereinafter. The shield cover is mounted on a rear surface of a circuit board by manually soldering by means of an soldering iron. As a result, there is a problem where a process of solder-fixing becomes longer and the number of working increases. In addition, there is another problem where thermal stress for the circuit board increases and quality becomes unstable because the shield cover is manually mounted on the rear surface of the circuit board.

An electronic component enabling efficient fixation of a shield cover to a sheet substrate (a circuit board) is disclosed in U.S. Pat. Application Publication No. 2008/0292846 A1 which will be called Patent Document 5 hereinafter. The shield cover disclosed in the Patent Document 5 is of quadrilateral lid shape and has four peripheral edge sides. In the Patent Document 5, to fix the shield cover to the sheet substrate, solder is not coated on the sheet substrate side, but attached to the shield cover side. Namely, in a transcription table to which creamy solder paste (cream solder) is supplied, the peripheral edge sides of the shield cover are dipped in the state of holding the shield cover by means of a holder (a vacuum nozzle) of an automatic component mounting machine (a mounter) and thereby the cream solder is attached to the peripheral edge sides of the shield cover. In this state, the shield cover is moved and disposed corresponding to a shield pad of the sheet substrate, by means of the automatic component mounting machine (the mounter). Next, the reflow process is performed in a state that the shield cover is placed on the sheet substrate, so as to fix the shield cover to the sheet substrate by soldering.

In the Patent Document 5, the shield cover is held by means of the holder (the vacuum nozzle) of the automatic component mounting machine (the mounter). Accordingly, it is possible to reduce the number of working. However, inasmuch as the shield cover disclosed in the Patent Document 5 is of the quadrilateral lid shape, the weight of the shield cover is cumbersome. As a result, it is necessary to become larger an attraction force of the holder (the attracting nozzle) of the automatic component mounting machine (the mounter). In other words, the automatic component mounting machine (the mounter) becomes upsizing.

A frame of a shield member for shielding by covering a region to be shielded of a circuit board and a method of mounting the shield member are disclosed in Japanese Unexamined Patent Publication Tokkai No. 2006-344814, namely, JP 2006-344814 A which is called Patent Document 6 hereinafter. In the Patent Document 6, the shield member comprises a shield cover and a frame. The frame of the shield member is provided at a standing state to an end edge portion of a region to be shielded of a circuit board and has an upside opening having a marginal frame wall surrounding the region to be shielded. The frame forms the shield member with the shield cover combined with the frame in the form of closing the upside opening. In the upside opening of the frame, a vacuum pad having a nozzle vacuumed surface to be vacuumed to a frame carrying vacuum nozzle is disposed such that it is supported and fixed to the marginal frame wall with beams which extend from a plurality of positions of the marginal frame wall and are formed, respectively. The vacuum pad is disposed above the upper end of the marginal frame wall.

A method of mounting the shield member disclosed in the Patent Document 6 comprises carrying the frame to the region to be shielded of the circuit board in a state where the nozzle vacuumed surface of the vacuum pad of the frame is vacuumed by the frame carrying vacuum nozzle to dispose the frame to the region to be shielded of the circuit board, cutting off the ends of beams at the marginal frame wall from the marginal frame wall to cut the vacuum pad and the beams from the marginal frame wall, and combining the shield cover with the frame in the form of closing the upside opening from which the vacuum pad and the beams have been removed. After the shield cover is combined with the frame, the frame and the shield cover are joint-fixed to the circuit board by means of a conductive connection material such as solder.

In the Patent Document 6, the frame is required in addition to the shield cover. As a result, there is a problem where the number of parts increases. In addition, in the Patent Document 6, after the shield cover is combined with the frame, the frame and the shield cover are joint-fixed to the circuit board by means of the conductive connection material such as solder. As a result, in the manner similar to the above-mentioned Patent Document 4, there are problems where a process of solder-fixing becomes longer and the number of working increases and thermal stress for the circuit board increases and quality becomes unstable.

SUMMARY OF THE INVENTION

It is therefore an object of this invention to provide an antenna unit, a shield cover used thereto, and a method of fabricating an antenna module which are capable of solder-fixing the shield cover to a rear surface of a circuit board by a reflow processing by means of a miniature mounter.

Other objects of this invention will become clear as the description proceeds.

According to a first exemplary aspect of the invention, an antenna unit comprises a circuit board having a main surface and a rear surface which are opposed to each other, a planar antenna element, mounted on the main surface of the circuit board, for receiving a radio wave, a signal processing circuit mounted on the rear surface of the circuit board and connected to the planar antenna element, a shield cover, mounted on the rear surface of the circuit board, for electromagnetic-shielding the signal processing circuit, and a bottom plate disposed so as to oppose to the shield cover. The shield cover comprises a tubular side wall portion extending from the rear surface of the circuit board in a direction perpendicular to a plane in which the circuit board extends, and a ceiling portion extending at edges of the tubular side wall portion in parallel with the plane in which the circuit board extends. The ceiling portion is opposed to the bottom plate. According to the first exemplary aspect of the invention, the ceiling portion comprises a mounter vacuumed portion disposed in a center portion of the ceiling portion and vacuumed by a vacuum nozzle of a mounter, a ring-shaped outer edge disposed from an end of the side wall portion inwardly, and a plurality of beam portions joining the mounter vacuumed portion to the outer edge. The antenna unit carries out an electromagnetic shielding of the signal processing circuit using both of the shield cover and the bottom plate.

According to a second exemplary aspect of the invention, a shield cover, disposed so as to oppose to a bottom plate, electromagnetic-shields a signal processing circuit mounted on a rear surface of a circuit board. The shield cover comprises a tubular side wall portion extending from the rear surface of the circuit board in a direction perpendicular to a plane in which the circuit board extends, and a ceiling portion extending at edges of the tubular side wall portion in parallel with the plane in which the circuit board extends. The ceiling portion is opposed to the bottom plate. According to the second exemplary aspect of the invention, the ceiling portion comprises a mounter vacuumed portion disposed in a center portion of the ceiling portion and vacuumed by a vacuum nozzle of a mounter, a ring-shaped outer edge disposed from an end of the side wall portion inwardly, and a plurality of beam portions joining the mounter vacuumed portion to the outer edge. With this structure, electromagnetic shielding of the signal processing unit is carried out using both of the shield cover and the bottom plate.

In a third exemplary aspect of the invention, a method of fabricating an antenna module comprises preparing a circuit board having a first surface and a second surface which are opposed to each other; applying solder pasts on the first surface of the circuit board at predetermined positions using a mask; mounting a plurality of mounted parts making up a signal processing circuit on the first surface of the circuit board; mounting a shield cover for shielding the signal processing circuit on the first surface of the circuit board by vacuuming the shield cover by a vacuum nozzle, the shield cover comprising a tubular side wall portion extending from the first surface of the circuit board in a direction perpendicular to a plane in which the circuit board extends, and a ceiling portion extending at edges of the tubular side wall portion in parallel with the plane in which the circuit board extends, the ceiling portion comprising a mounter vacuumed portion disposed in a center portion of said ceiling portion and vacuumed by the vacuum nozzle, a ring-shaped outer edge disposed from an end of the side wall portion inwardly, and a plurality of beam portions joining the mounter vacuumed portion to the outer edge; solder-fixing, by a reflow processing, the plurality of mounted parts and the shield cover on the first surface of the circuit board; and mounting a planar antenna element for receiving a radio wave on the second surface of the circuit board to electrically connect the planar antenna element with the signal processing circuit.

BRIEF DESCRIPTION OF THE DRAWINGS

FIGS. 11A to 11G are diagrams showing a packing member used in the antenna unit illustrated in FIG. 10, wherein FIG. 11A is a plan view of the packing member, FIG. 11B is a front view of the packing member, FIG. 11C is a right side view of the packing member, FIG. 11D is a rear view of the packing member, FIG. 11E is a bottom view of the packing member, FIG. 11F is a sectional view taken along line A-A in FIG. 11A, and FIG. 11G is a sectional view taken along line B-B in FIG. 11A;

FIGS. 12A to 12D are diagrams showing a bottom plate used in the antenna unit illustrated in FIG. 10, wherein FIG. 12A is a bottom view of the bottom plate, FIG. 12B is a front view of the bottom plate, FIG. 12C is a side view of the bottom plate, and FIG. 12D is a sectional view taken along line A-A in FIG. 12A.

DESCRIPTION OF THE PREFERRED EMBODIMENTS

Figure 1A:
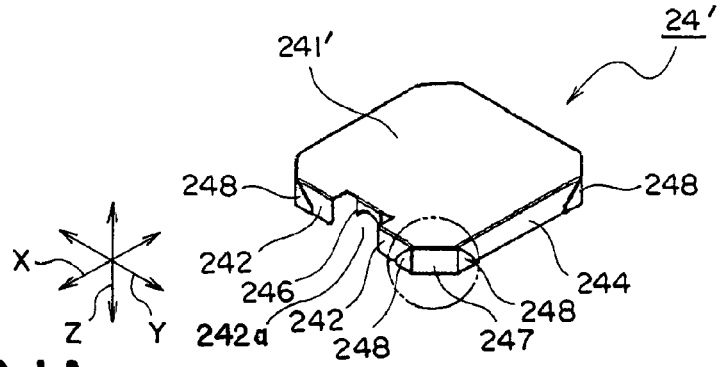
FIG. 1A PRIOR ART
FIG. 1A is an external perspective view showing an overall appearance of a conventional shield cover.
Figure 1B:
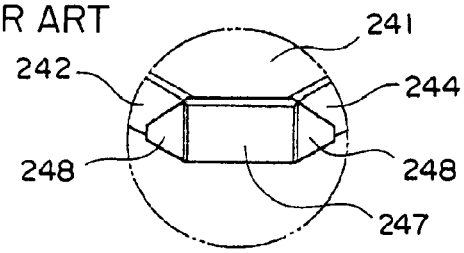
FIG. 1B PRIOR ART
FIG. 1B is a fragmentary enlarged view of a portion enclosed by a circle of a two-dot-dash line of FIG. 1A.
Figure 2:
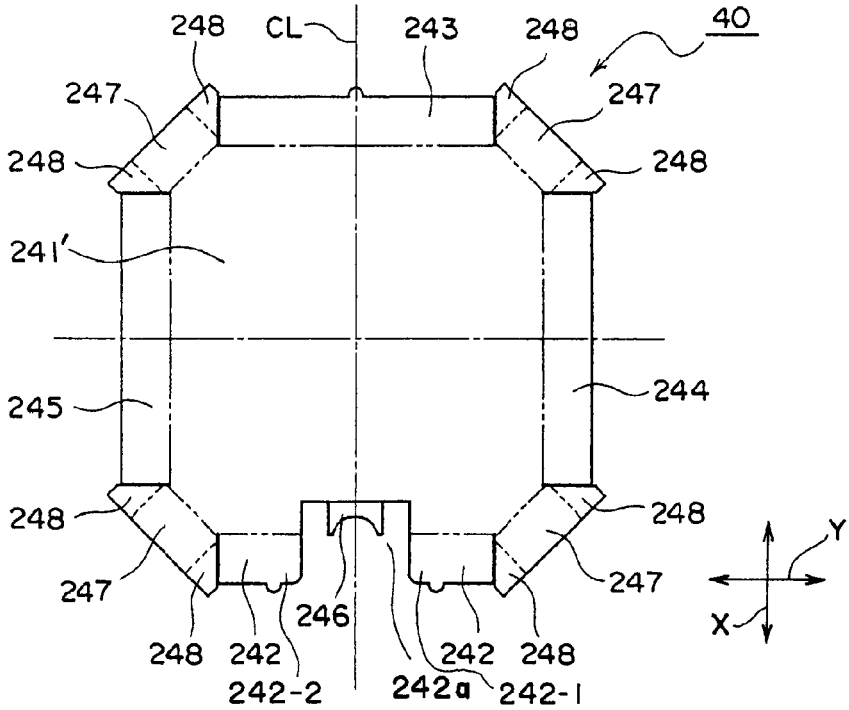
FIG. 2 PRIOR ART
FIG. 2 is a plan view of a metal plate for forming the conventional shield cover illustrated in FIG. 1A.

Referring to FIGS. 1A, 1B, and 2, a conventional shield cover 24' disclosed in the above-mentioned Patent Document 4 will be described at first in order to facilitate an understanding of the present invention. FIG. 1A is an external perspective view showing an overall appearance of the conventional shield cover 24'. FIG. 1B is a fragmentary enlarged view of a portion enclosed by a circle of a two-dot-dash-line of FIG. 1A. FIG. 2 is a plan view of a metal plate 40 for forming the conventional shield cover 24'.

In FIGS. 1A and 2, an orthogonal coordinate system (X, Y, Z) is used. In a state illustrated in FIGS. 1A and 2, an X-axis direction is a fore-and-aft direction (a depth direction), a Y-axis direction is a left-and-right direction (a width direction), and a Z-axis direction is an up-and-down direction (a height direction).

The metal plate 40 has a shape which is bilaterally symmetrical about a central line CL extending the fore-and-aft direction X. More specifically, the metal plate 40 comprises a substantially rectangular ceiling portion 241' with four corners which are chamfered, and four side wall portions 242, 243, 244, and 245 which are formed at four sides of the ceiling portion 241'. The four side wall portions 242, 243, 244, and 245 are called front side wall portion, rear side wall portion, a right side wall portion, and a left side wall portion, respectively. The front side wall portion 242 consists of a pair of front side wall pieces 242-1 and 242-2 which are apart from each other so that the central line CL forms the boundary therebetween and between which an opening (a coaxial cable insertion hole) 242*a* is left. In addition, between the pair of front side wall pieces 242-1 and 242-2, a holding piece 246 for holding a coaxial cable (not shown) is formed.

The metal plate 40 further comprises four corner portions 247 at the four corners. Each corner portion 247 comprises, at both ends, a pair of extension portions 248 overlapped with adjacent side wall portions.

By bending the front side wall portion 242, the rear side wall portion 243, the right side wall portion 244, the left side wall portion 245, the holding piece 246, and the four corner portions 247 at right angles to the ceiling portion 241' (at right angles towards a rear side with respect to a paper surface of FIG. 2) and by bending the extension portions 248 at right angle to the respective adjacent side wall portions along a dot-dash-line, the shield cover 24' illustrated in FIG. 1A is formed.

Figure 3:
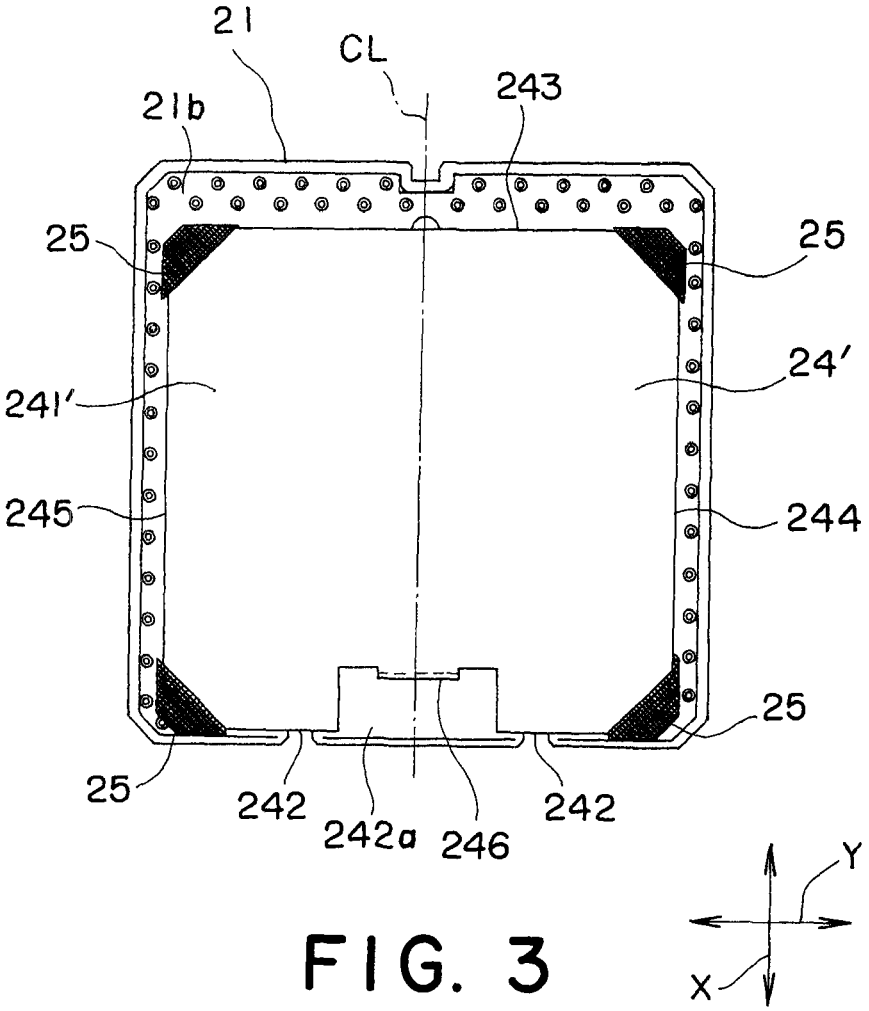
FIG. 3 PRIOR ART
FIG. 3 is a bottom view showing a state where the conventional shield cover is mounted to a rear surface of a circuit board by means of solder.

FIG. 3 is a bottom view showing a state where the conventional shield cover 24' is mounted to a rear surface 21*b* of a circuit board (a printed-wiring board) 21 by means of solder 25. As shown in FIG. 3, the shield cover 24' is mounted on the rear surface 21*b* of the circuit board (the printed wiring board) 21 by soldering to the rear surface 21*b* of the circuit board (the printed-wiring board) 21 at the corner portions 247 by means of the solder 25. That is, the shield cover 24' is mounted on the rear surface 21*b* of the circuit board (the printed-wiring board) 21 by manually soldering by means of an soldering iron.

Inasmuch as the shield cover 24' is soldered on the rear surface 21*b* of the circuit board 21 at the four corners thereof, it is possible to make length and width dimensions of the shield cover 24' larger up to the substantially same level of length and width dimensions of the circuit board 21. There is no gap in folded portions of the shield cover 24'. In other words, there are no gap between the four side wall portions 242 to 245 and the four corner portions 247.

In the manner which is described above, in the conventional shied cover 24', the shield cover 24' is mounted on the rear surface 21*b* of the circuit board (the printed wiring board) 21 by manually soldering by means of an soldering iron. As a result, there is a problem where a process of solder-fixing becomes longer and the number of working increases, as mentioned in the preamble of the instant specification. In addition, there is another problem where thermal stress for the circuit board 21 increases and quality becomes unstable because the shield cover 24' is manually mounted on the rear surface 21*b* of the circuit board 21, as also mentioned in the preamble of the instant specification.

Figure 4:
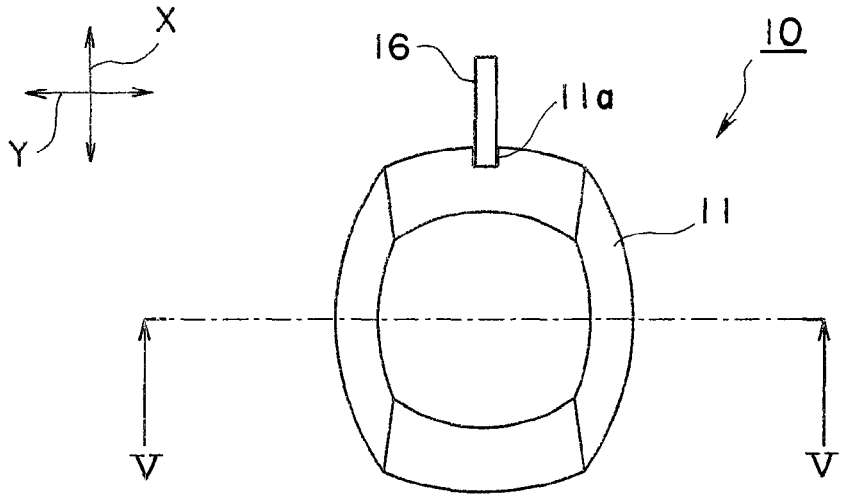
FIG. 4 is a plan view of an antenna unit according to a first exemplary embodiment of this invention.
Figure 5:
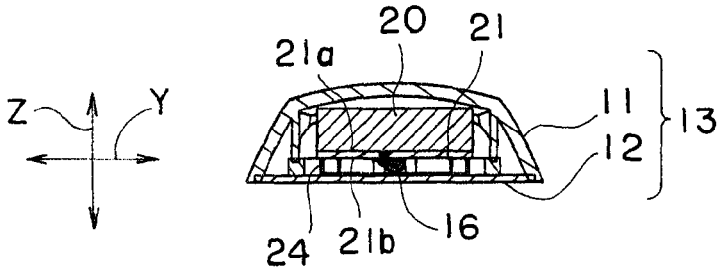
FIG. 5 is a cross-sectional view taken on line V-V of FIG. 4.
Figure 6:
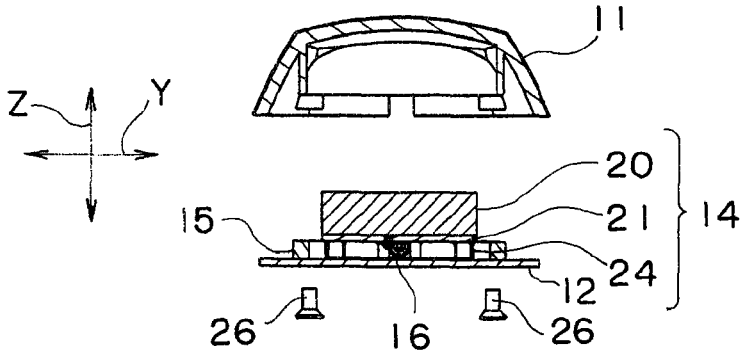
FIG. 6 is an exploded cross-sectional view of the antenna unit illustrated in FIG. 5.

Referring to FIGS. 4, 5, and 6, description will be made about an antenna unit 10 according to a first exemplary embodiment of this invention. The illustrated antenna unit 10 is an antenna unit for GPS signal reception. FIG. 4 is a plan view of the antenna unit 10. FIG. 5 is a cross-sectional view taken on line V-V of FIG. 4. FIG. 6 is an exploded cross-sectional view of the antenna unit 10 illustrated in FIG. 5;

In FIGS. 4 to 6, an orthogonal coordinate system (X, Y, Z) is used. In a state illustrated in FIGS. 4 to 6, an X-axis direction is a fore-and-aft direction (a depth direction), a Y-axis direction is a left-and-right direction (a width direction), and a Z-axis direction is an up-and-down direction (a height direction).

The antenna unit 10 comprises an antenna case 13, an antenna module 14, a packing member (a gasket) 15, and a signal line (a coaxial cable) 16. The antenna case 13 is composed of a domed top cover 11 and a bottom plate 12. The antenna module 14 is disposed in the top cover 11. The packing member (the gasket) 15 is disposed between the top cover 11 and the bottom plate 12 to thereby ensure watertightness of the antenna case 13. Inasmuch as the packing member (the gasket) 15 serves to provide a waterproof function, it is also called a waterproof packing. The signal line (the coaxial cable) 16 is connected to the antenna module 14.

The antenna module 14 comprises a planar antenna element 20 and a circuit board (a printed-wiring board) 21. The planar antenna element 20 is formed with an antenna for receiving GPS signals transmitted from GPS satellites. The illustrated planar antenna element 20 comprises a patch antenna element. The circuit board 21 has a main surface 21*a* and a rear surface 21*b* which are opposed to each other. The planar antenna element 20 is mounted on the main surface 21*a* of the circuit board 21. On the rear surface 21*b* of the circuit board 21, a signal processing circuit (which will later be described) is mounted. The signal processing circuit is adapted to perform various signal processing such as signal amplification with respect to a GPS signal received by the planar antenna element 20. The planar antenna element 20 and the main surface 21*a* of the circuit board 21 are bonded together by the use of a double-sided adhesive tape (not shown) or the like.

The signal line (the coaxial cable) 16 is connected to the rear surface 21*b* of the circuit board 21 for outputting the GPS signal to the outside of the antenna case 13. Further, a shield case 24 for electromagnetic-shielding the above-mentioned signal processing circuit is attached to the rear surface 21*b* of the circuit board 21. The signal line (the coaxial cable) 16 is drawn out to the outside through a cutout portion 11*a* formed at the top cover 11.

The antenna unit 10 is assembled by fixing the top cover 11 and the bottom plate 12 together by the use of a plurality of screws 26 (two screws alone are shown in FIG. 6) in the state where the antenna module 14 and the packing member (the gasket) 15 are disposed in an inner space of the top cover 11.

The packing member (the gasket) 15 is made of a resin material such as a silicone rubber.

As apparent from FIGS. 5 and 6, in the illustrated antenna unit 10, the bottom plate 12 exists immediately below the shield cover 24. In other words, when the antenna module 14 is accommodated in the antenna case 13, the bottom plate 12 is disposed so as to be opposed to the shield cover 24. Accordingly, in the manner which will later be described, although a hole or holes (an opening portion or opening portions) is or are pierced in a ceiling portion of the shield cover 24, it has structure where the hole or the holes (the opening portion or the opening portions is or are covered with the bottom plate 12. As a result, an electromagnetic shielding of the above-mentioned signal processing circuit is carried out using both of the bottom plate 12 and the shield cover 24.

Figure 7:
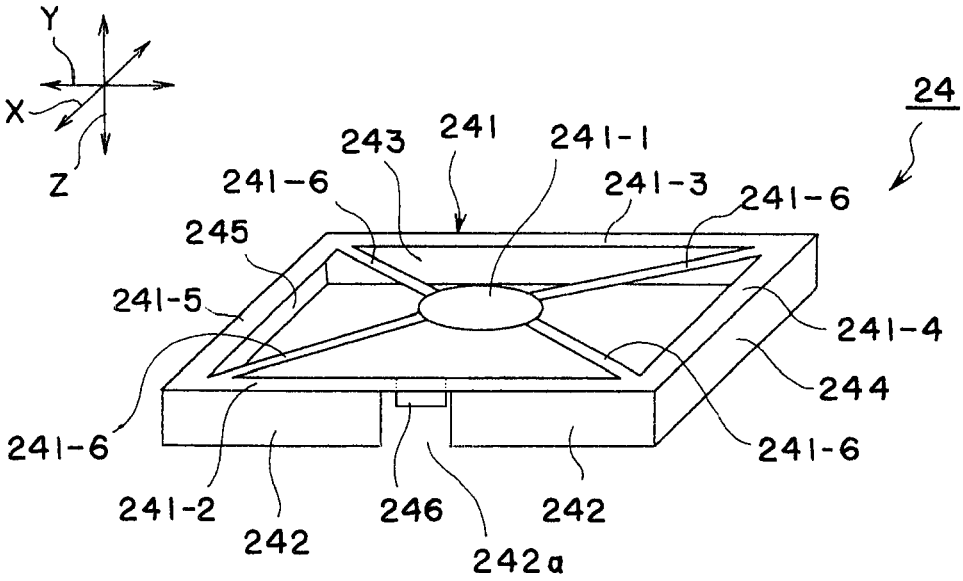
FIG. 7 is a perspective view of a shield cover for use in the antenna unit illustrated in FIG. 6.

Referring to FIG. 7, description will be made about structure of the shield cover 24 for use in the antenna unit 10 illustrated in FIGS. 4 to 6.

The illustrated shield cover 24 is similar in structure to the conventional shield cover 24' illustrated in FIGS. 1A and 2 except that structure of the ceiling portions are mainly different from each other in the manner which will later be described. Accordingly, the ceiling portion is depicted at a reference sign of 241. In the shield cover 24, the same reference signs are attached to ones having functions similar to those in the shield cover 24' illustrated in FIGS. 1A and 2.

Different from the conventional shield cover 24', the shield cover 24 does not comprise the four corner portions 247 and the extension potions 248. Accordingly, in the shield cover 24, a side wall portion (242 to 245) consisting of the front side wall portion 242, the rear side wall portion 243, the right side wall portion 244, and the left side wall portion 245 has a substantially tubular shape. The side wall portion (242 to 245) extends from the rear surface 21*b* of the circuit board 21 in a direction (the up-and-down direction Z) perpendicular to a plane (an X-Y plane) in which the circuit board 21 extends.

The ceiling portion 241 extends at edges of the tubular side wall (242 to 245) in parallel with the plane (the X-Y plane) in which the circuit board 21 extends and is disposed so as to be opposed to the bottom plate 12.

The ceiling portion 241 comprises a mounter vacuumed portion 241-1, a front outer edge 241-2, a rear outer edge 241-3, a right outer edge 241-4, a left outer edge 241-5, and four beam portions 241-6.

The front outer edge 241-2 is disposed from an end of the front side wall portion 242 inwardly. The rear outer edge 241-3 is disposed from an end of the rear side wall portion 243 inwardly. The right outer edge 241-4 is disposed from an end of the right side wall portion 244 inwardly. The left outer edge 241-5 is disposed from an end of the left side wall portion 245 inwardly. Accordingly, an outer edge (241-2 to 241-5) consisting of the front outer edge 241-2, the rear outer edge 241-3, the right outer edge 241-4, and the left outer edge 241-5 comprises a rectangular ring-shaped outer edge.

The mounter vacuumed portion 241-1 is disposed in a center portion of the ceiling portion 241 and comprise a portion which is vacuumed by a vacuum nozzle of a mounter (which will later be described). The four beam portions 241-6 join the mounter vacuumed portion 241-1 to the outer edge (241-2 to 241-5). In the example being illustrated, the four beam portions 241-6 have an X-shape that extend from four corners of the rectangular ring-shaped outer edge (241-2 to 241-5) toward the mounter vacuumed portion 241-1.

Although the side wall portion (242 to 245) has the rectangular tubular shape in the illustrated first exemplary embodiment, the side wall portion may have other tubular shapes. Likewise, although the outer edge (241-2 to 241-5) has the rectangular ring-shape in the illustrated first exemplary embodiment, the outer edge may have other ring-shape. Furthermore, although the beam portions 241-4 are equal in number to four in the illustrated first exemplary embodiment, the number of the beam portions is not limited to four and the number of the beam portions may be two or more. In addition, although the beam portions 241-6 have the X-shape in the illustrated first exemplary embodiment, as a matter of course, the beam portions may have other shapes such as a cross shape or the like.

In the manner which is described above, inasmuch as the illustrated shield cover 24 has a shape where the ceiling portion 241 has opening portions, it is possible to make its weight light in comparison with the conventional shield cover 24'. As a result, it is possible to vacuum the shield cover 24 by means of a vacuum nozzle of a miniature mounter. Accordingly, it is possible to solder-fix the shield cover 24 to the rear surface 21*b* of the circuit board 21 by a reflow processing by means of the miniature mounter, in the manner which will later be described.

In addition, inasmuch as the electromagnetic shielding of the signal processing circuit is carried out by using both of the bottom plate 12 and the shield cover 24 in the antenna unit 10 according to the first exemplary embodiment in the manner which is described above, it is unnecessary to use the shield member comprising the shield cover and the frame as disclosed in the above-mentioned Patent Document 6. That is, inasmuch as the bottom plate 12 acts as the electromagnetic shielding, it is unnecessary to use another shield special part in addition to the shield cover 24 in order to electromagnetic-shield the signal processing circuit.

Referring now to FIGS. 8A to 8G, the description will proceed to a method of fabricating the antenna module 14 for use in the antenna unit 10.

Figure 8A:
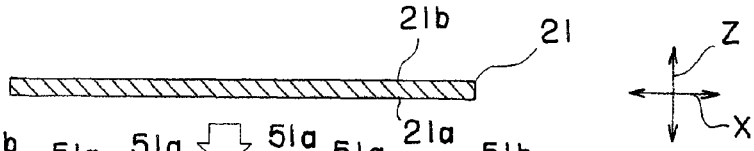
FIGS. 8A to 8G are sectional views showing processes for use in describing a method of fabricating an antenna module for use in the antenna unit illustrated in FIG. 4.

First, as shown in FIG. 8A, the circuit board 21 having a first surface 21*b* and a second surface 21*a* which are opposed to each other is prepared. Herein, it is noted that the first surface 21*b* correspond to the rear surface of the circuit board 21 and the second surface 21*a* corresponds to the main surface of the circuit board 21. On the second surface (the rear surface) 21*b*, a plurality of electrode pads (not shown) and a shield pad is formed. The plurality of electrode pads are adapted to be connected to terminals of a plurality of mounted parts (which will later be described) making up the above-mentioned signal processing circuit while the shield pad is adapted to be connected to an end side of the side wall portion (242 to 245) of the shield cover 24.

Figure 8B:
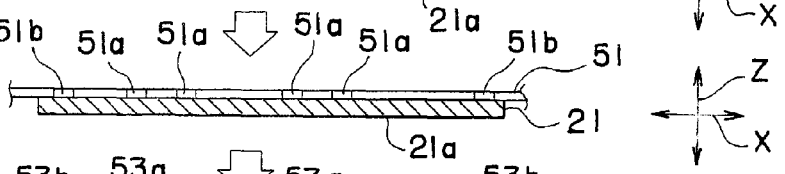

Subsequently, as shown in FIG. 8B, a mask 51 is mounted on the first surface 21*b* of the circuit board 21. The mask 51 has a plurality of electrode pad holes 51*a* bored at positions corresponding to the above-mentioned electrode pads and a shield pad hole 51*b* bored at a position corresponding to the above-mentioned shield pad.

Figure 8C:
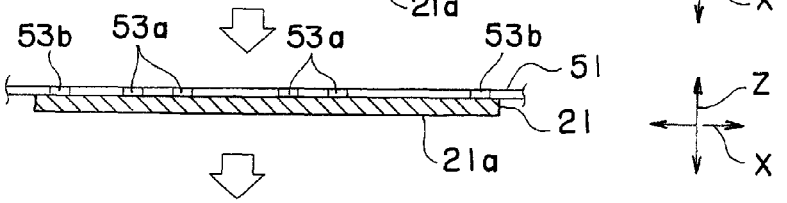

Next, as shown in FIG. 8C, solder pasts 53*a* and 53*b* are applied on the above-mentioned plurality of electrode pads and the above-mentioned shield pad through the above-mentioned plurality of electrode pad holes 51*a* and the above-mentioned shield pad hole 51*b* of the mask 51, respectively. Thereafter, the mask 51 is peeled from the first surface (the rear surface) 21*b* of the circuit board 21.

In the manner which is described above, the solder pasts 53*s* and 53*b* are applied on the first surface (the rear surface) 21*b* of the circuit board 21 at predetermined positions (the electrode pads and the shield pad).

Figure 8D:
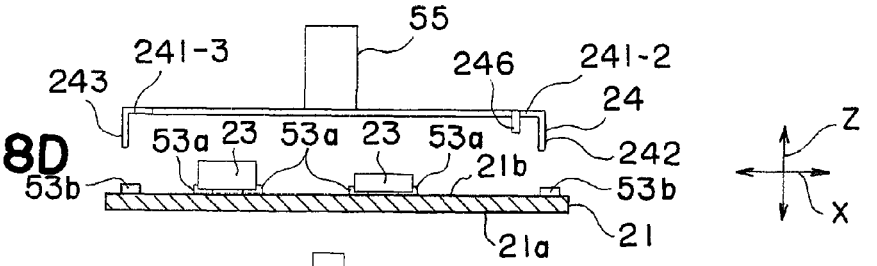

Next, as shown in FIG. 8D, a plurality of parts 23 making up the signal processing circuit are mounted on the first surface 21*b* of the circuit board 21 by vacuuming the plurality of parts 23 by a vacuum nozzle 55 of a miniature mounter. In this event, the plurality of parts 23 are connected to the plurality of electrode pads via the solder pasts 53*a*.

Figure 8E:
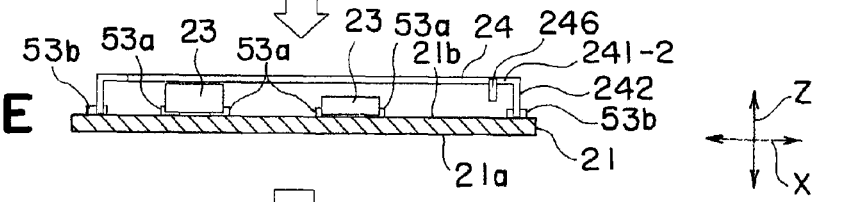

Subsequently, as shown in FIGS. 8D and 8E, the shield cover 24 is mounted on the first surface 21*b* of the circuit board 21 by vacuuming the mounter vacuumed portion 241-1 (FIG. 7) of the shield cover 24 by the vacuum nozzle 55 of the miniature mounter. In this event, as shown in FIG. 8E, the end side of the side wall portion (242 to 245) of the shield cover 24 is connected to the shield pad via the solder past 53*b*.

Figure 8F:
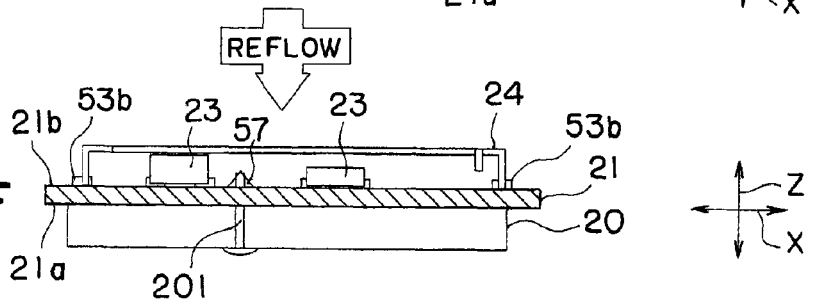

Next, as shown in FIG. 8F, the plurality of mounted parts 23 and the shield cover 24 are solder-fixed on the first surface 21*b* of the circuit board 21 by a reflow processing.

Subsequently, as shown in FIG. 8F, a planar antenna element 20 for receiving a radio wave is mounted on the second surface (the main surface) 21*a* of the circuit board 21. Thereafter, a feeding pin 201 of the planar antenna element 20 is connected to a pattern (not shown) of the first surface 21*b* of the circuit board 21 by means of solder 57. Thereby, the planar antenna element 20 and the signal processing circuit (the mounted parts 23) are electrically connected.

Figure 8G:
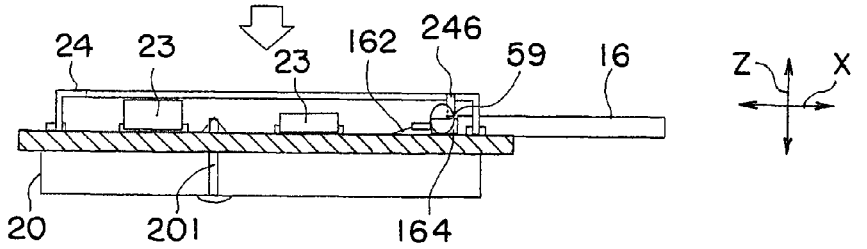

Finally, as shown in FIG. 8G, a tip portion of a coaxial cable (a signal line) 16 is inserted (mounted) on the first surface (the main surface) 21*a* of the circuit board 21 via the opening (the coaxial cable insertion hole) 242*a* of the shield cover 24 and a central conductor 162 and an outer conductor 164 of the coaxial cable 16 that are exposed at the tip portion of the coaxial cable 16 are connected on the first surface 21*b* of the circuit board 21 by means of solder 59. In this event, the outer conductor 164 of the coaxial cable 16 is electrically also connected to the holding piece 246 of the shield cover 24. Therefore, the shield cover 24 and the outer conductor 164 of the coaxial cable 16 have a same potential.

In the manner which is described above, in the first exemplary embodiment, it is possible to fix, by the solder 53*b*, the shield cover 24 to the rear surface 21*b* of the circuit board 21 by the reflow processing by means of the miniature mounter.

In addition, inasmuch as the ceiling portion 241 of the shield cover 24 has the opening portions, it is possible to connect the feeding pin 201 of the planar antenna element 20 and the coaxial cable 16 on the rear surface 21*b* of the circuit board 21 by means of the solder 57 and 59 after shield cover 24 is fixed on the rear surface 21*b* of the circuit board 21 by means of the solder 53*b*.

Figure 9:
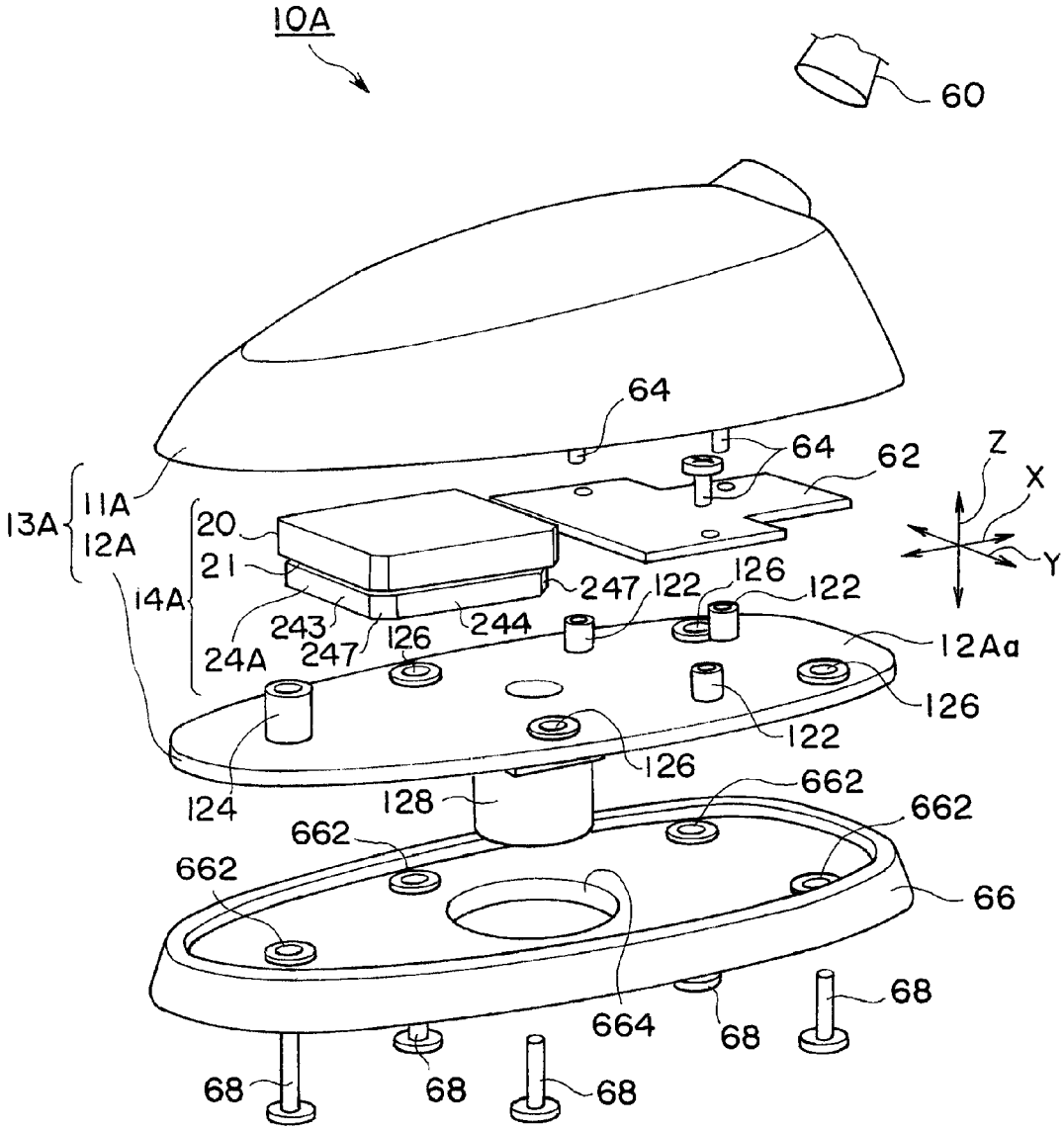
FIG. 9 is an exploded perspective view of an antenna unit according to a second exemplary embodiment of this invention.

Referring to FIG. 9, description will be made about an antenna unit 10A according to a second exemplary embodiment of this invention. The illustrated antenna unit 10A comprises a hybrid antenna unit in which an antenna module 14A for SDARS signal reception and a bar antenna 60 are combined. FIG. 9 is an exploded perspective view of the hybrid antenna unit 10A.

The antenna module 14A is similar in structure to the antenna module 14 illustrated in FIG. 6 except that structure of shield cover is modified from that shown in FIG. 7 in the manner which will later be described. Accordingly, the shield cover is depicted at a reference sign of 24A.

The shield cover 24A is similar in structure to the shield cover 24 illustrated in FIG. 7 except that structure of the side wall portion is modified in the manner which will later be described.

That is, the side wall portion of the shield cover 24 illustrated in FIG. 7 comprises the front side wall portion 242, the rear side wall portion 243, the right side wall portion 244, and the left side wall portion 245 alone while the side wall portion of the shield cover 24A illustrated in FIG. 9 comprises four corner portions 247 as well as these four side wall portions (242 to 245).

The hybrid antenna unit 10A comprises an antenna case 13A which is composed of a domed top cover 11A and a bottom plate 12A. An antenna module 14A is disposed in the top cover 11A. The illustrated bottom plate 12A is made of a die-cast.

In the illustrated hybrid antenna unit 10A also, the bottom plate 12A exists immediately below the shield cover 24A. In other words, when the antenna module 14A is accommodated in the antenna case 13A, the bottom plate 12A is disposed so as to be opposed to the shield cover 24A. Accordingly, although a hole or holes (an opening portion or opening portions) is or are pierced in the ceiling portion 241 (FIG. 7) of the shield cover 24A, it has structure where the hole or the holes (the opening portion or the opening portions is or are covered with the bottom plate 12A. As a result, an electromagnetic shielding of the signal processing circuit is carried out using both of the bottom plate 12A and the shield cover 24A.

The bar antenna 60 is inserted in the top cover 11A. The bar antenna 60 comprises an antenna for receiving a radio wave of AM/FM and for transmitting/receiving a radio wave for a cellular phone.

A second circuit board 62 is also disposed in the top cover 11A. On the second circuit board 62, a booster circuit for AM/FM is mounted. The bottom plate 12A has a main surface 12Aa on which three screw bosses 122 stand. On the three bosses 122, the second circuit board 62 is fixed by means of three screws 64. Accordingly, the second circuit board 62 is disposed apart from the main surface 12*a* of the bottom plate 12A.

In addition, at a front side of the bottom plate 12A, a screw boss 124 stands on the main surface 12Aa thereof. The bottom plate 12A has four screw holes 126 at both sides.

A base pad 66 is mounted to a lower portion of the bottom plate 12A. The base pad 66 has five through holes 662 at positions corresponding to the above-mentioned screw hole 124 and the above-mentioned four screw holes 126. By inserting five screws 68 from the base pad 66 to the bottom plate 12A, the bottom plate 12A is secured to the top cover 11A by the five screws 68 and fixed thereto.

In addition, the bottom plate 12A comprises a cylindrical bolt 128 which extends from a lower surface thereof downward. The base pad 66 has a through hole 664 through which the bolt 128 passes.

A roof (not shown) of a car body (a mobile body) of an automobile or the like has an opening through which the above-mentioned bolt 128 passes. By screwing a nut (not shown) to the bolt 128 which projects from the opening, the hybrid antenna unit 10A is fixed on the roof of the mobile body (the car body).

A signal line (an coaxial cable) (not shown) having a tip portion inserted (fixed) in the shield cover 24A is routed through the above-mentioned cylindrical bolt 128 in the interior of the car body (the mobile body). In addition, a signal line connected to the above-mentioned booster circuit for the AM/FM and a signal line for the cellular antenna are also routed through the above-mentioned cylindrical bolt 128 in the interior of the car body (the mobile body).

Figure 10:
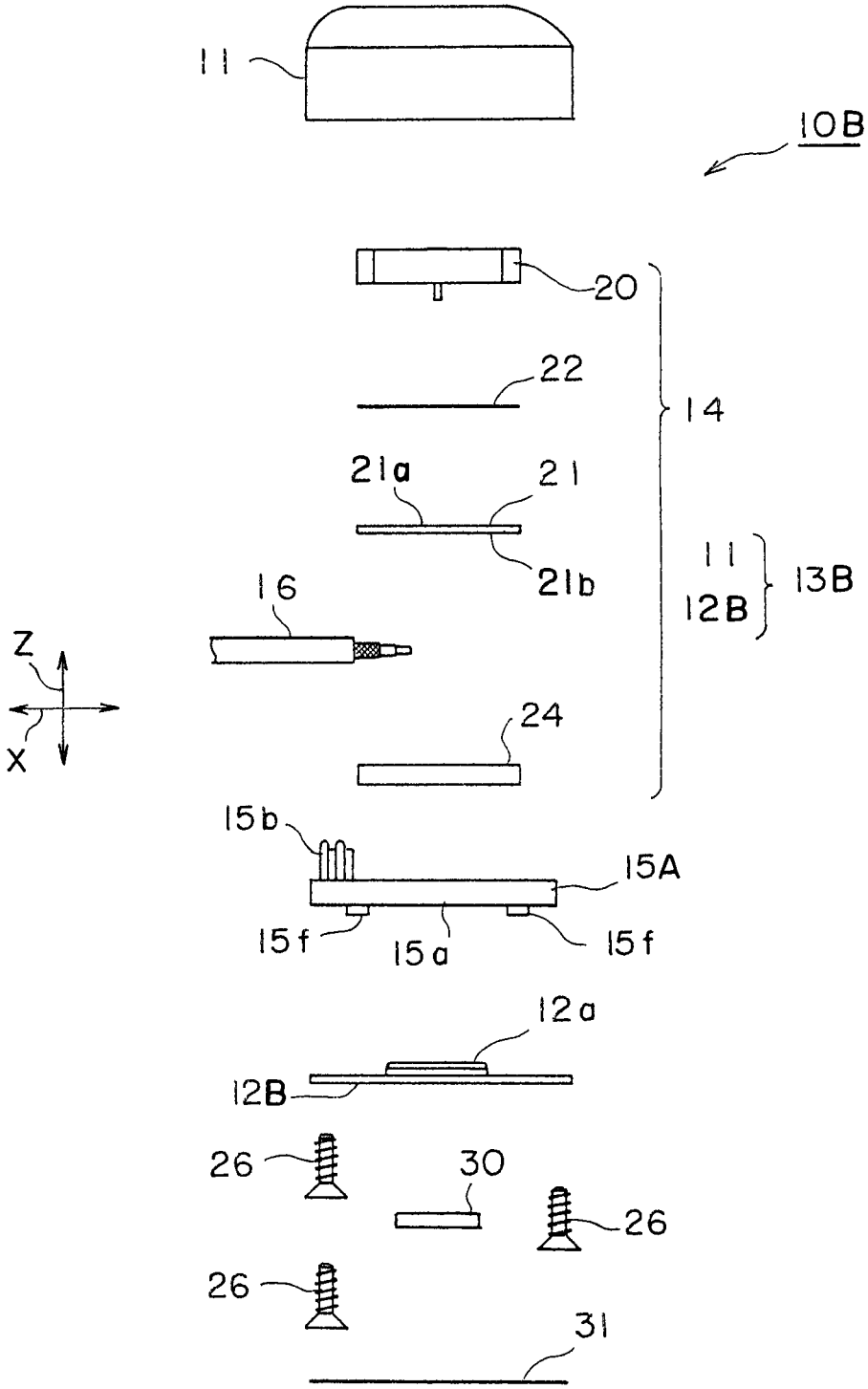
FIG. 10 is a schematic exploded diagram showing an antenna unit according to a third exemplary embodiment of this invention.

Referring to FIG. 10, description will be made about an antenna unit 10B according to a third exemplary embodiment of this invention. The illustrated antenna unit 10B is an antenna unit for GPS signal reception.

The illustrated antenna unit 10B is similar in structure to the antenna unit 10 illustrated in FIGS. 4 to 6 except that the packing member (the gasket) and the bottom plate are modified in the manner which will later be described. Accordingly, the packing member (the gasket) and the bottom plate are depicted at reference signs of 15A and 12B, respectively. The same reference signs are attached to components similar to those in the antenna unit 10 illustrated in FIGS. 4 to 6 and overlapped description is omitted for the sake of simplification of description.

By combining the domed top cover 11 with the bottom plate 12B, an antenna case 13B is composed. The planar antenna element 20 and the main surface 21*a* of the circuit board 21 are bonded together by the use of a double-sided adhesive tape 22 or the like.

The antenna unit 10B is assembled by fixing the top cover 11 and the bottom plate 12B together by the use of three screws 26 in the state where the antenna module 14 and the packing member (gasket) 15A are disposed in an inner space of the top cover 11.

Figure 11E:
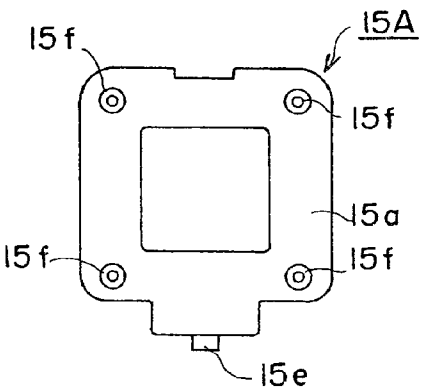
Figure 11C:
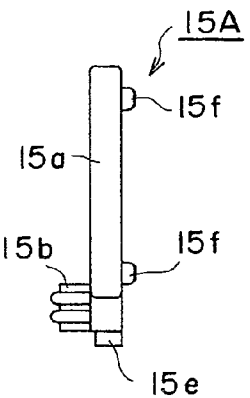
Figure 11D:
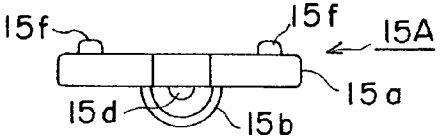
Figure 11A:
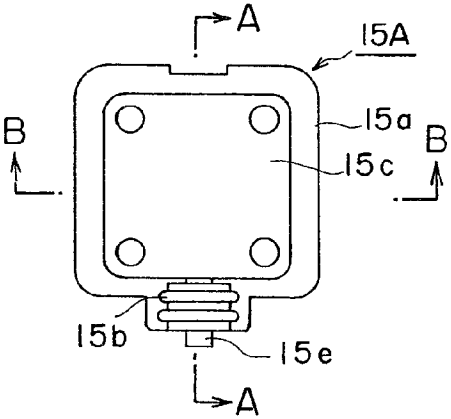
Figure 11B:
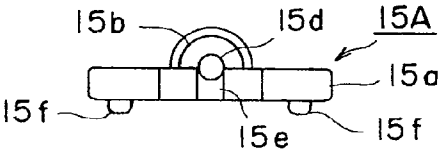
Figure 11G:
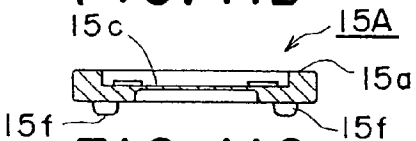
Figure 11F:
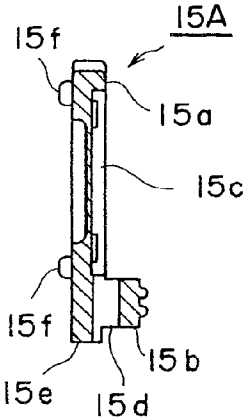

Referring to FIGS. 11A to 11G, the structure of the packing member (the gasket) 15A will be described in further detail. FIG. 11A is a plan view of the packing member (the gasket) 15A, FIG. 11B is a front view of the packing member (the gasket) 15A, FIG. 11C is a right side view of the packing member (the gasket) 15A, FIG. 11D is a rear view of the packing member (the gasket) 15A, FIG. 11E is a bottom view of the packing member (the gasket) 15A, FIG. 11F is a sectional view taken along line A-A in FIG. 11A, and FIG. 11G is a sectional view taken along line B-B in FIG. 11A.

The packing member (the gasket) 15A comprises a base portion 15*a* covering the whole surface of the antenna module 14, and a gasket portion 15*b* covering the outer periphery of the signal line (the coaxial cable) 16 at a position of the cutout portion 11*a* (see FIG. 4) formed at eh top cover 11.

The base portion 15*a* has a concave portion 15*c*. Positioning of the antenna module 14 is carried out by the concave portion 15*c*. The concave portion 15*c* has a shape that covers substantially the whole bottom surface of the antenna module 14.

The packing member (the gasket) 15A is held between the top cover 11 and the bottom plate 12B when the top cover 11 and the bottom plate 12B are joined together. The packing member (the gasket) 15A is disposed for the purpose of ensuring watertightness at the joining portion between the top cover 11 and the bottom plate 12B. The gasket portion 15*b* is formed so as to rise from the base portion 15*a* at the position corresponding to the cutout portion 11*a* of the top cover 11. The gasket portion 15*b* has a hole 15*d* at its center portion for insertion of the signal line (the coaxial cable) 16 therethrough.

The packing member (the gasket) 15A has a convex portion 15*e* extending outward from the lower side of the hole 15*d*. The convex portion 15*e* contacts the lower side of the signal line (the coaxial cable) 16 to thereby form a waterproof structure. The convex portion 15*e* is provided so as to be exposed to the outside from the cutout portion 11*a* of the top cover 11, thereby forming part of the surface of the antenna body. The packing member (the gasket) 15A further comprises four projecting portions (legs) 15*f* provided at the lower surface of the base portion 15*a*. These projecting portions 15*f* pass through the bottom plate 12A and a resin sheet 31 so as to be exposed from the bottom surface of the antenna body. These projecting portions 15*f* serve to prevent slippage of the antenna body when it is placed on a roof of an automobile.

Figure 12A:
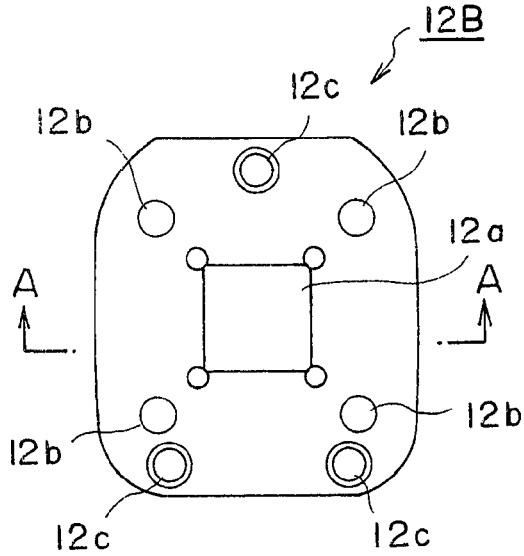
Figure 12C:
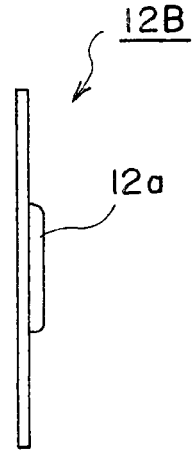
Figure 12B:
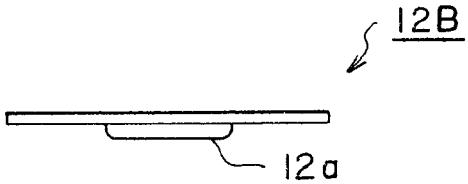
Figure 12D:
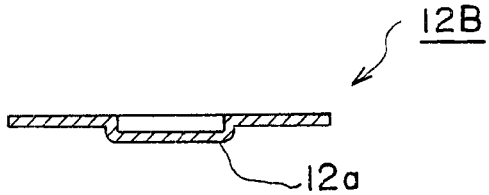

Referring to FIGS. 12A to 12D, the structure of the bottom plate 12B will be described. FIG. 12A is a bottom view of the bottom plate 12B, FIG. 12B is a front view of the bottom plate 12B, FIG. 12C is a side view of the bottom plate 12B, and FIG. 12D is a sectional view taken along line A-A in FIG. 12A.

The bottom plate 12B is formed with a single concave portion 12*a* at its center portion. A permanent magnet 30 is disposed in the concave portion 12*a*. The permanent magnet 30 is used for fixing by attraction the antenna unit 10 to the roof of the automobile. The bottom plate 12B is formed with four through holes 12*b* for allowing the four projecting portions 15*f* of the packing member (the gasket) 15A to pass therethrough. The bottom plate 12B is further formed with three holes 12*c* for insertion of the three screws 26 therethrough.

As shown in FIG. 10, for the purpose of preventing damage to the roof of the automobile, the resin sheet 31 is stuck to a main surface of the bottom plate 12B on its side exposed outward so as to cover substantially the whole of the main surface of the bottom plate 12B. A type number, a name, etc. of the antenna unit 10B are printed on the resin sheet 31.

Figure 13:
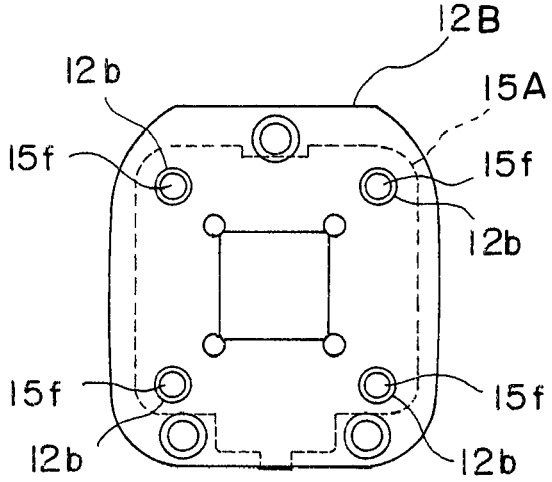
FIG. 13 is a bottom view showing the state where the packing member illustrated in FIGS. 11A to 11G and the bottom plate illustrated in FIGS. 12A to 12D are combined together.

FIG. 13 shows the state where the bottom plate 12B and the packing member (the basket) 15A are combined together. As seen from FIG. 13, the diameter of each through hole 12*b* of the bottom plate 12B is greater than that of each projecting portion 15*f* of the packing member (the gasket) 15A.

Further, the length of each projecting portion 15*f* is shortened to a degree such that even if the projecting portion 15*f* is elastically deformed laterally, the projecting portion 15*f* does not abut the edge of the through hole 12*b*. Further, as shown in FIG. 11B, the tip portion of each projecting portion 15*f* is R-shaped (rounded).

With the structure as described above, even if the projecting portion 15*f* is elastically deformed laterally, the projecting portion 15*f* escapes into the through hole 12*b* of the bottom plate 12B without abutting the edge of the through hole 12*b* of the bottom plate 12B and, therefore, the operation performance in antenna assembly is improved.

As apparent from FIGS. 11F and 11G, in the packing member (the gasket) 15A, the concave portion 15*c* of the base portion 15*a* has a very thin thickness. For example, the thickness of the concave portion 15*c* is about 0.2 mm to 0.5 mm.

Accordingly, through the thin concave portion 15*c* of the packing member (the gasket) 15A, the shield cover 24 and the bottom plate 12B are disposed so as to be opposed to each other. As a result, in the antenna unit 10B according to the third exemplary embodiment also, an electromagnetic shielding of the above-mentioned signal processing circuit is carried out using both of the bottom plate 12B and the shield cover 24.

In the antenna unit according to the first exemplary aspect of this invention, the side wall portion may have a rectangular tubular shape and the outer edge may comprise a rectangular ring-shaped outer edge. The plurality of beam portions may consist of four beam portions having an X-shape that extend from four corners of the rectangular ring-shaped outer edge toward the mounter vacuumed portion. The tubular side wall portion of the shield cover may have an opening. In this event, the antenna unit further may comprise a coaxial cable having a tip portion which is inserted in the shield cover via the opening and which is soldered on the rear surface of the circuit board. The shield cover further may comprise a holding piece holding the coaxial cable. The antenna unit may comprise a Global Positioning System (GPS) antenna unit which receives, as the radio wave, GPS signals transmitted from GPS satellites. Alternatively, the antenna unit may comprise a Satellite Digital Audio Radio Service (SDARS) antenna unit which receives, as the radio wave, SDARS signals from SDRAS satellites.

In the shield cover according to the second exemplary aspect of this invention, the side wall portion may have a rectangular tubular shape and the outer edge may comprise a rectangular ring-shaped outer edge. The plurality of beam portions may consist of four beam portions having an X-shape that extend from four corners of the rectangular ring-shaped outer edge toward the mounter attracted portion. The tubular side wall portion of the shield cover may have an opening through which a tip portion of a coaxial cable is inserted in the shield cover. The shield cover further may comprise a holding piece holding the coaxial cable.

In the method of fabricating an antenna module according to the third exemplary aspect of this invention, the side wall portion of the shield cover preferably may have an opening through which a tip portion of a coaxial cable is inserted in the shield cover. In this event, the method may further comprise solder-connecting, on the first surface of the circuit board, a central conductor and an outer conductor of the coaxial cable that are exposed at the tip portion of the coaxial cable which is inserted in the shield cover via the opening.

An exemplary advantage according to the invention is that it is possible to solder-fix a shield cover to a rear surface of a circuit board by a reflow processing by means of a miniature mounter because a ceiling portion of the shield cover disposed oppose to a bottom plate comprises a mounter vacuumed portion disposed in a center portion of the ceiling portion and vacuumed by a vacuum nozzle of the mounter, a ring-shaped outer edge disposed from an end of a side wall portion inwardly, and a plurality of beam portions joining the mounter vacuumed portion to the outer edge, thereby carrying out an electromagnetic shielding of a signal processing circuit using both of the shield cover and the bottom plate.

While this invention has been particularly and described with reference to exemplary embodiments thereof, the invention is not limited to these embodiments. It will be understood by those or ordinary skilled in the art that various changes in form and details may be made therein without departing from the sprit and scope of the present invention as defined by the claims. For example, the antenna units described in the embodiments are suitable as an antenna unit for GPS signal reception or an antenna unit for SDARS signal reception, but not limited thereto, and is also applicable as an antenna unit for mobile communication adapted to receive other satellite waves, ground waves, or other radio waves.

What is claimed is:

1. An antenna unit comprising:

a circuit board having a main surface and a rear surface which are opposed to each other;

a planar antenna element mounted on the main surface of said circuit board, said planar antenna element being configured to receive a radio wave;

a signal processing circuit mounted on the rear surface of said circuit board, said signal processing circuit being connected to said planar antenna element;

a shield cover mounted on the rear surface of said circuit board, said shield cover electromagnetic-shielding said signal processing circuit; and a bottom plate disposed so as to oppose to said shield cover, wherein said shield cover comprises:

a tubular side wall portion extending from the rear surface of said circuit board in a direction perpendicular to a plane in which said circuit board extends; and a ceiling portion extending at edges of said tubular side wall portion in parallel with the plane in which said circuit board extends, wherein ceiling portion is opposed to said bottom plate, wherein said ceiling portion comprises:

a mounter vacuumed portion disposed in a center portion of said ceiling portion, wherein said mounter vacuumed portion is capable of being vacuumed by a vacuum nozzle of a mounter;

a ring-shaped outer edge disposed to extend inwardly from an end of said side wall portion; and a plurality of beam portions joining said mounter vacuumed portion to said outer edge, wherein said bottom plate is disposed directly below the ceiling portion of said shield cover, and the ceiling portion comprises opening portions covered with said bottom plate, and wherein said antenna unit carries out electromagnetic shielding of said signal processing circuit using both of said shield cover and said bottom plate.

2. The antenna unit as claimed in claim 1, wherein said side wall portion has a rectangular tubular shape and said outer edge comprises a rectangular ring-shaped outer edge.

3. The antenna unit as claimed in claim 2, wherein said plurality of beam portions consist of four beam portions having an X-shape that extend from four corners of said rectangular ring-shaped outer edge toward said mounter vacuumed portion.

4. The antenna unit as claimed in claim 1, wherein said tubular side wall portion of said shield cover has an opening, and wherein said antenna unit further comprises a coaxial cable having a tip portion which is inserted in said shield cover via said opening and which is soldered on the rear surface of said circuit board.

5. The antenna unit as claimed in claim 4, wherein said shield cover further comprises a holding piece for holding said coaxial cable.

6. The antenna unit as claimed in claim 1, wherein said antenna unit comprises a Global Positioning System (GPS) antenna unit which receives, as said radio wave, GPS signals transmitted from GPS satellites.

7. The antenna unit as claimed in claim 1, wherein said antenna unit comprises a Satellite Digital Audio Radio Service (SDARS) antenna unit which receives, as said radio wave, SDARS signals from SDRAS satellites.

8. A shield cover, disposed so as to oppose to a bottom plate, for electromagnetic-shielding a signal processing circuit mounted on a rear surface of a circuit board, said shield cover comprising:

a tubular side wall portion extending from the rear surface of said circuit board in a direction perpendicular to a plane in which said circuit board extends; and a ceiling portion extending at edges of said tubular side wall portion in parallel with the plane in which said circuit board extends, said ceiling portion being opposed to said bottom plate, wherein said ceiling portion comprises:

a mounter vacuumed portion disposed in a center portion of said ceiling portion, wherein said mounter vacuumed portion is capable of being vacuumed by a vacuum nozzle of a mounter;

a ring-shaped outer edge disposed to extend inwardly from an end of said side wall portion; and a plurality of beam portions joining said mounter vacuumed portion to said outer edge, wherein said bottom plate is disposed directly below the ceiling portion of said shield cover, and the ceiling portion has opening portions covered with said bottom plate, thereby carrying out an electromagnetic shielding of said signal processing unit using both of said shield cover and said bottom plate.

9. The shield cover as claimed in claim 8, wherein said side wall portion has a rectangular tubular shape and said outer edge comprises a rectangular ring-shaped outer edge.

10. The shield cover as claimed in claim 9, wherein said plurality of beam portions consist of four beam portions having an X-shape that extend from four corners of said rectangular ring-shaped outer edge toward said mounter attracted portion.

11. The shield cover as claimed in claim 8, wherein said tubular side wall portion of said shield cover has an opening through which a tip portion of a coaxial cable is insertable into said shield cover.

12. The shield cover as claimed in claim 11, further comprising a holding piece for holding said coaxial cable.

* * * * *